US006823587B2

(12) United States Patent
Reed

(10) Patent No.: US 6,823,587 B2
(45) Date of Patent: Nov. 30, 2004

(54) METHOD OF MAKING A CABLE STRUCTURE FOR DATA SIGNAL TRANSMISSION

(75) Inventor: Bruce Reed, Richmond, VT (US)

(73) Assignee: Tensolite Company, St. Augustine, FL (US)

( * ) Notice: Subject to any disclaimer, the term of this patent is extended or adjusted under 35 U.S.C. 154(b) by 105 days.

(21) Appl. No.: 10/212,491

(22) Filed: Aug. 5, 2002

(65) Prior Publication Data

US 2002/0193009 A1 Dec. 19, 2002

Related U.S. Application Data

(62) Division of application No. 09/629,228, filed on Jul. 31, 2000, now Pat. No. 6,428,344.

(51) Int. Cl.[7] ..... H01R 43/00

(52) U.S. Cl. ..... 29/858; 29/854; 29/855; 29/856; 29/857; 439/604; 439/936

(58) Field of Search ..... 439/936, 275, 439/276, 494, 455, 523, 736, 497, 577, 499, 610, 604, 95, 608, 579; 29/854, 855, 856, 857, 858, 862

(56) References Cited

U.S. PATENT DOCUMENTS

| | | | | |
|---|---|---|---|---|
| 3,033,919 | A | 5/1962 | Aschinger | |
| 3,149,893 | A | 9/1964 | Dupre | |
| 3,587,028 | A | 6/1971 | Uberbacher | 339/14 |
| 3,587,029 | A | 6/1971 | Knowles | |
| 3,689,865 | A | 9/1972 | Pierini et al. | 339/17 |
| 4,005,921 | A | 2/1977 | Hadden et al. | 339/14 R |
| 4,094,564 | A | 6/1978 | Cacolici | 339/14 |
| 4,123,842 | A | 11/1978 | Cooper | 29/592 R |
| 4,130,934 | A | 12/1978 | Asick et al. | 29/628 |
| 4,153,326 | A | 5/1979 | Frantz et al. | 339/99 R |
| 4,181,394 | A | 1/1980 | Dodge | |
| 4,274,699 | A | 6/1981 | Keim | 339/176 |
| 4,275,945 | A | 6/1981 | Krantz et al. | 339/147 |
| 4,337,989 | A | 7/1982 | Asick et al. | 339/143 R |
| 4,352,531 | A | 10/1982 | Gutter | 339/14 R |

(List continued on next page.)

FOREIGN PATENT DOCUMENTS

| | | |
|---|---|---|
| DE | 42 94 443 T1 | 1/1994 |
| EP | 0 211 496 | 2/1987 |
| JP | 49-6543 | 1/1974 |
| JP | 50-18198 | 2/1975 |
| JP | 52-33091 | 3/1977 |
| JP | 54-15294 | 2/1979 |
| JP | 54-110491 | 8/1979 |
| JP | 58-379 | 1/1983 |
| JP | 60-93780 | 5/1985 |
| JP | 60-115475 | 6/1985 |
| JP | 61-172480 | 8/1986 |
| JP | 63-158766 | 7/1988 |
| JP | 2-155178 | 6/1990 |
| JP | 6-509676 | 10/1994 |
| WO | WO 93/12564 | 6/1993 |
| WO | WO 98/00890 | 1/1998 |

*Primary Examiner*—Richard Chang
(74) *Attorney, Agent, or Firm*—Wood, Herron & Evans, LLP

(57) ABSTRACT

A method of making a data cable includes coupling an electrical conductor of an end of a cable to an electrical contact that is positioned within a portion of a connector housing. A protective clamp is positioned over a section of the cable rearwardly of the electrical contact. Another portion of the connector housing is formed over the cable section and the clamp, to thereby secure the cable with the connector housing. The protective clamp is positioned between the formed portion of the connector housing and the cable section and provides mechanical protection for the cable section to reduce damage thereto.

9 Claims, 4 Drawing Sheets

U.S. PATENT DOCUMENTS 4,362,350 A 12/1982 von Harz ..... 339/143
4,406,512 A 9/1983 Schell ..... 339/177 R
4,451,099 A 5/1984 Bricker, Jr. et al. ..... 339/14 R
4,470,657 A 9/1984 Deacon ..... 339/143 R
4,508,415 A * 4/1985 Bunnell ..... 439/497
4,601,527 A 7/1986 Lemke ..... 339/14 R
4,602,830 A 7/1986 Lockard ..... 339/14 R
4,602,831 A 7/1986 Lockard ..... 339/14 R
4,606,596 A * 8/1986 Whiting et al. ..... 439/465
4,615,578 A 10/1986 Stadler et al. ..... 339/143 R
4,619,487 A 10/1986 Brush, Jr. ..... 339/14 R
4,623,211 A 11/1986 Dambach et al. ..... 339/143 R
4,653,825 A 3/1987 Olsson ..... 339/48
4,653,836 A 3/1987 Peele ..... 339/143 R
4,653,837 A 3/1987 Phillipson et al. ..... 339/143 R
4,655,515 A 4/1987 Hamsher, Jr. et al. .... 339/14 R
4,655,518 A 4/1987 Johnson et al. ..... 339/17
4,659,163 A 4/1987 Althouse et al. ..... 339/143
4,671,599 A 6/1987 Olsson ..... 439/188
4,673,236 A 6/1987 Musolff et al. ..... 439/609
4,678,121 A 7/1987 Douty et al. ..... 439/610
4,679,879 A 7/1987 Triner et al. ..... 439/425
4,681,382 A 7/1987 Lockard ..... 439/92
4,707,040 A 11/1987 Hansel, III ..... 439/510
4,710,133 A 12/1987 Lindeman ..... 339/14
4,737,117 A 4/1988 Lockard ..... 439/92
4,767,345 A 8/1988 Gutter et al. ..... 439/92
4,772,212 A 9/1988 Sotolongo ..... 439/98
4,773,878 A 9/1988 Hansell, III ..... 439/497
4,781,620 A 11/1988 Tengler et al. ..... 439/497
4,790,775 A 12/1988 David ..... 439/579
4,808,115 A 2/1989 Norton et al. ..... 439/79
4,820,175 A 4/1989 Hasegawa et al. ..... 439/98
4,824,383 A 4/1989 Lemke ..... 439/108
4,826,443 A 5/1989 Lockard ..... 439/101
4,840,573 A 6/1989 Seidel et al. ..... 439/92
4,842,555 A 6/1989 Cosmos et al. ..... 439/609
4,846,727 A 7/1989 Glover et al. ..... 439/608
4,925,400 A 5/1990 Blair et al. ..... 439/374
4,946,397 A 8/1990 Grasser ..... 439/532
4,963,104 A * 10/1990 Dickie ..... 439/460
4,973,264 A 11/1990 Kamono et al. ..... 439/498
4,975,069 A 12/1990 Fedder et al. ..... 439/101
4,981,447 A 1/1991 Ichitsubo ..... 439/607
4,985,000 A 1/1991 Tengler et al. ..... 439/497
4,990,094 A 2/1991 Chandler et al. ..... 439/108
5,009,614 A 4/1991 Fogg et al. ..... 439/497
5,032,089 A 7/1991 Hansell, III ..... 439/609
5,035,631 A 7/1991 Piorunneck et al. ..... 439/108
5,052,948 A 10/1991 Hyzin ..... 439/607
5,057,028 A 10/1991 Lemke et al. ..... 439/101
5,057,038 A 10/1991 Bowen et al. ..... 439/497
5,059,140 A 10/1991 Philippson et al. ..... 439/607
5,066,236 A 11/1991 Broeksteeg ..... 439/79
5,085,596 A 2/1992 Bowen et al. ..... 439/497
5,100,347 A * 3/1992 Malasky et al. ..... 439/604
5,102,344 A 4/1992 Tadokoro et al. ..... 439/98
5,104,341 A 4/1992 Gilissen et al. ..... 439/608
5,115,562 A 5/1992 Bowen et al. ..... 29/867
5,116,230 A 5/1992 Dechelette et al. ..... 439/101
5,141,445 A 8/1992 Little ..... 439/108
5,160,273 A 11/1992 Carney ..... 439/108
5,176,538 A 1/1993 Hansell, III et al. ..... 439/607
5,190,472 A 3/1993 Voltz et al. ..... 439/579
5,194,020 A 3/1993 Voltz ..... 439/579
5,823,825 A 10/1998 Murphy
6,203,376 B1 3/2001 Magajne et al.

* cited by examiner

METHOD OF MAKING A CABLE STRUCTURE FOR DATA SIGNAL TRANSMISSION

This application is a divisional of application Ser. No. 09/629,228, filed Jul. 31, 2000 now U.S. Pat. No. 6,428,344.

FIELD OF THE INVENTION

This present invention relates generally to signal transmission cable structures for electronic devices and particularly to improving the performance and construction of such a cable structure for high speed data transmission.

BACKGROUND OF THE INVENTION

The use of electronic devices of all kinds is ever increasing, which has led to a significant increase in the demand for improved components utilized with such devices. One facet in the utilization of such electronic devices involves networking multiple devices together and establishing data communications between the various devices within a networked system. For example, many electronic devices may be coupled together and synchronized with other electronic devices, such as a central control system or computer. Data is transmitted at very high speeds between the networked devices within a system.

For fast and accurate data and information transmission in a networked system, the individual system devices must be optimized when they are networked together so that the system functions at a suitable performance level. Particularly, the interface components of the devices in the system, which allow the various electronic devices to be networked, must be optimized for greater speed and performance. One particularly important interface or interconnect component is the transmission cable which extends between the electronic devices that are communicating. Various cable designs have been utilized for such data and information transmission.

Generally, suitable cable structures utilize a plurality of electrical conductors and a connector structure at one or both ends which interfaces with a networked electronic device. For example, connectors of a cable might plug into appropriate socket structures in the electronic devices. In many applications, the cables are arranged in a high density cable arrangement which is configured to plug into a central backplane which includes a large number of sockets. Data cables include signal conductors, that is, transmission lines which carry the actual data or information signals, and ground conductors which provide an electrical reference for the transmitted data and information.

While the construction of existing cable structures has been suitable for maintaining the integrity of the data signals transmitted thereon, significant attention has still been paid to the termination components or connectors of the cable structure. The connectors of the cable structure provide an electrical transition between the individual electrical conductors of the cable structure, and hence the transmitted signals, and the internal circuitry of the electronic device to which the cable structure is connected. Generally, such connectors utilize a plurality of conductive contacts, often in the form of metal strips, pins and/or tabs. The signal and ground conductors of the cable terminate at the contacts of the connector, and are electrically coupled to the contacts. The electronic device or backplane, into which the connector is plugged, then includes its own set of contacts, such as pins or tabs within a socket, for example, for interfacing with the contacts of the cable connector. Typically, the connector will engage the socket in the traditional male-female relationship. However, various other different connector structures have been utilized as evidenced by numerous patents in the field directed to connector designs.

In existing high speed data cable structures, the contacts of the connector are often housed in an individual plastic, insulative housing piece. The individual cables are then attached to the contacts in the housing piece, such as by soldering the cable conductors to the contacts. Thereafter, the rest of the plastic connector housing, such as in the form of a flat wafer, is molded over the housing piece, over the contacts and over sections of the cables to form the complete connector housing. The connector housing interface with the cables couples the housing to the cables to provide strain relief to the contact/conductor connection. This helps to prevent the cables from being pulled from the connector. A metal shield might also be placed over a side of the connector body is some designs to eliminate electrical interference and crosstalk from affecting the cable at the site of the connector. In currently available designs, the connector housing is thin, such as a 2 millimeter thick wafer, so that high densities of connectors may be stacked next to each other and plugged into a socket.

The manufacturing of the connector, and particularly the molding of the wafer housing over the ends of the cables and over the individual housing piece and contacts, exposes the cable ends to significant heat and pressure associated with the molding process. This degrades the overall integrity of the cable structure. First, the pressure of the mold tends to pinch and smash the ends of the cables where they engage the connector housing and contacts. The cables, which may have a circular cross section, are smashed into oblong cross sections at their ends. This affects the integrity of the insulation of the cable and the conductors, such as the metal braid which surrounds the center conductor in a coaxial cable. Furthermore, the heat of the process only enhances the physical deformation of the cables. Such mechanical damage to the cables affects the electrical integrity of the overall cable structure. For example, cable disconnections at the connector and/or short circuits may result due to the mechanical damage from the molding process. As a result, the cable structures are less robust. Furthermore, the integrity of the data signal sent over the cable may be affected. Cable structures used for high speed data transmission (e.g. rates as high as 1 Gigabit/second) are particularly susceptible to mechanical damage, because the high frequency signals are more sensitive to variations in the mechanical and electrical features of the cables which may exist at the connector termination.

It is therefore desirable to make cable structures for high speed data transmission which are mechanically and electrically more sound than existing cable structures. To that end, attempts have been made to reduce the affects of the manufacturing process on the electrical integrity of the cable structure. Furthermore, efforts are always ongoing to improve the electrical characteristics of the cable and to improve the quality of the signal and ground connections. Attenuation reduction and crosstalk reduction are particular goals for high speed data cables. Also tight signal skews and better reliability are also desirable characteristics.

Therefore, it is desirable to have a cable structure for high speed data communication which has improved signal integrity through the connector of the cable structure.

It is also desirable to have a mechanically and electrically robust and reliable cable structure and connector.

Furthermore, it is desirable to reduce the mechanical and electrical damage to a cable structure incurred during manufacturing and installation of the connector on the cable structure.

It is further desirable to have a connector design which is sufficiently compact, but which maintains a useful density of signal conductors for high speed data applications.

These objectives and other objectives will become more readily apparent from the summary of invention and detailed description of embodiments of the invention set forth herein below.

SUMMARY OF THE INVENTION

A cable structure in accordance with the principles of the present invention comprises one or more cables terminating in a connector. The connector comprises a housing with a front end and a rear end and including a plurality of electrical contacts positioned within the housing proximate the front end. The contacts of the connector are configured for engaging the corresponding contacts of an electrical device when the cable structure is coupled to the device. The conductors of the cable, such as a signal conductor and a ground conductor, terminate in the connector housing. Specifically, the conductors are each electrically coupled to a respective housing contact. A signal conductor of the cable connects to a signal contact, and the ground conductor connects to a ground contact, in one embodiment of the invention.

The cable structure may further comprise a metal shield positioned on one face of the housing. The shield is electrically coupled to the ground contact for electrically grounding the shield through the ground contact. Alternatively, the ground conductor of the cable may be connected directed to the shield, wherein the shield is then connected to the contact to thereby define the ground contact.

The connector housing that supports and houses the contacts is coupled with sections of the various cables rearwardly of the contacts. In one embodiment, a portion of the connector housing is molded around the sections of the cables to thereby couple the housing to the sections of the cables. In accordance with one aspect of the present invention, a protective clamp is interposed between the connector housing and the cable sections which are coupled to the connector housing. The protective clamp, which may be formed of a rigid material such as metal, provides mechanical protection for the cable sections to reduce damage thereto which may result from molding or otherwise forming the connector housing over sections of the cables. Specifically, the protective clamp protects the cable sections over which a portion of the housing is molded, to thereby reduce the effects of the heat and pressure of the molding process on the individual cables of the cable structure. The cable structure may include one or more cables, and therefore, the protective clamp may be appropriately sized for use with one or multiple cables.

In one embodiment, the protective clamp comprises two parts or portions which are similarly formed to create a clamshell structure which fits over the cable sections. The parts are appropriately configured to overlay the various cables. Tabs on either end of the individual clamp parts are adjacent to each other when the clamp is in position. Apertures are formed in the tabs so that when the connector housing is molded around the protective clamp and coupled with the cable sections under the clamp, molten plastic flows through the apertures, thereby locking the clamp together and coupling the clamp with the connector housing and the cables.

In another aspect of the present invention, an open window section is formed in the housing and is positioned between the contacts and the protective clamp. The open window section exposes other sections of the cables to further reduce damage to the cable when the connector housing is molded therearound. That is, the open window section eliminates a portion of the connector housing which would otherwise engage the cable sections and thereby eliminates exposure of those cable sections to the heat and pressure of the molding process. The open window section, and the protective clamp, in combination, have been found to improve the overall integrity and robustness of the cable structure. Alternatively, the protective clamp may be utilized alone without an open window section. To that end, the clamp may be dimensioned in length to cover the sections of the cables which would otherwise be susceptible to damage from the heat and pressure of the housing molding process.

One suitable connector housing for the cable structure of the invention is a thin, wafer-like shape with a thickness of approximately 2 milimeters. With such a connector housing, multiple connectors may be stacked together in high density fashion to interface with a device, such as a socket. The cable structure further comprises one or more latch tabs which are coupled to the connector housing. The latch tabs are configured for being engaged by a latch structure when a cable structure is coupled to an electrical device, such as a socket, for securing the cable structure in the socket in a high density cable arrangement. These and other features of the invention will become more readily apparent from the Detailed Description below.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

Figure 1:
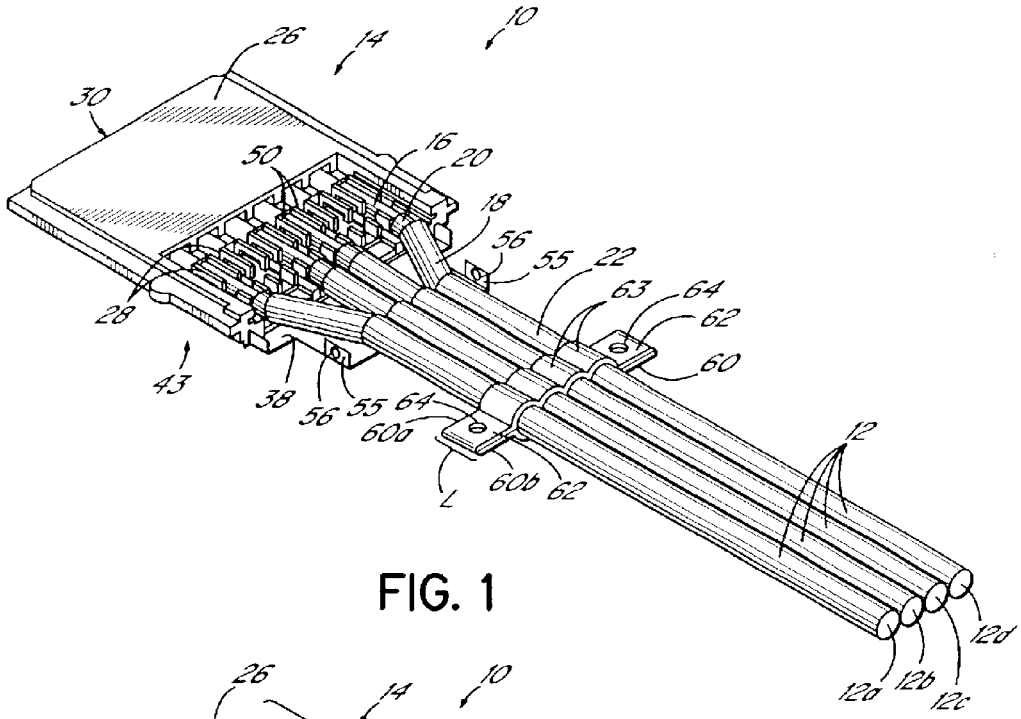
FIG. 1 is a perspective view of one embodiment of the invention with part of the connector housing removed.

FIG. 1 is a perspective view, partially cut away, illustrating one embodiment of the present invention. Cable structure 10 comprises one or more cables or transmission lines 12 terminating in a connector 14. In the embodiment illustrated in FIG. 1, four individual cables 12*a*, 12*b*, 12*c*, 12*d* terminate in the connector 14. A single cable could be utilized in the invention, or a greater number of transmission lines than those shown in FIG. 1 may also be utilized in accordance with the principles of the present invention.

The individual cables 12 could be of any suitable form. In the figures each of the cables 12 is a coaxial cable and includes a center conductor 16 and an outer conductor 18. Generally, the center conductor is the signal conductor of the cable and the outer conductor is the ground conductor or drain conductor. Suitable center conductors for the invention are multi-stranded copper wires or solid copper wires. The outer conductor could be a metal braid or other suitable structure. Each of the center conductors 16 are separately insulated by insulation 20, which may be extrude onto the conductors. The outer conductor 18 is then positioned over the insulation layer 20. A jacket 22 of insulative material covers the cable and may be extruded over the conductor 18. Suitable insulative materials, such as insulative thermoplastics may be used for layers 20, 22. It will be understood by a person of ordinary skill in the art that the type of transmission line or cable used in the invention could take any suitable form and is not limited to that shown in the Figures.

Figure 2:
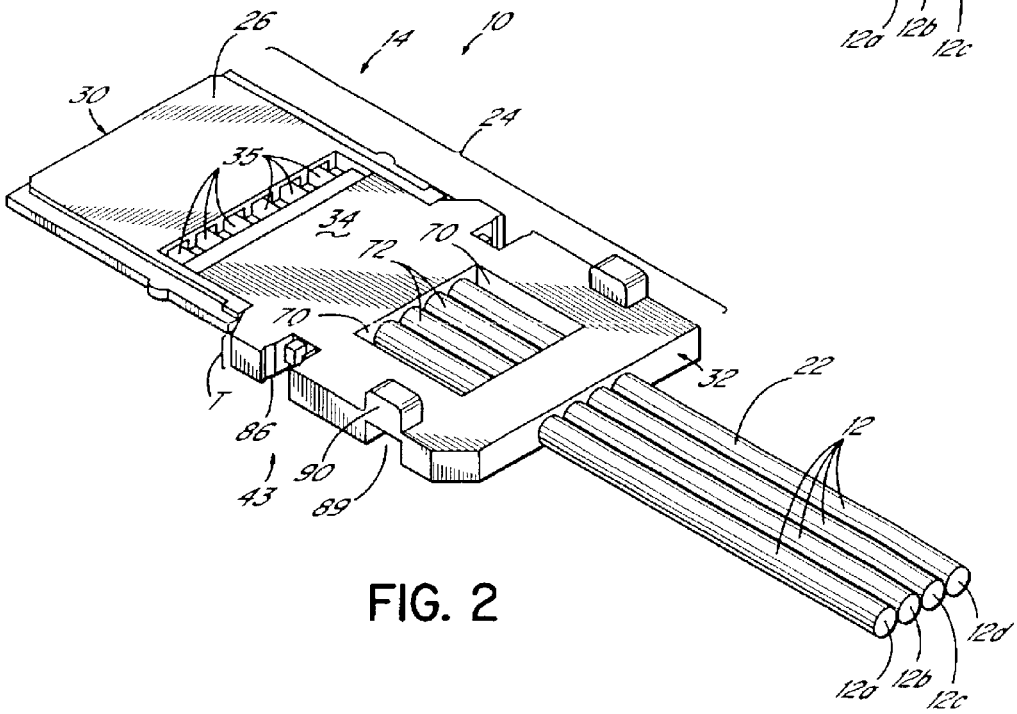
FIG. 2 is a perspective view showing one embodiment of the invention and the complete connector housing.
Figure 5:
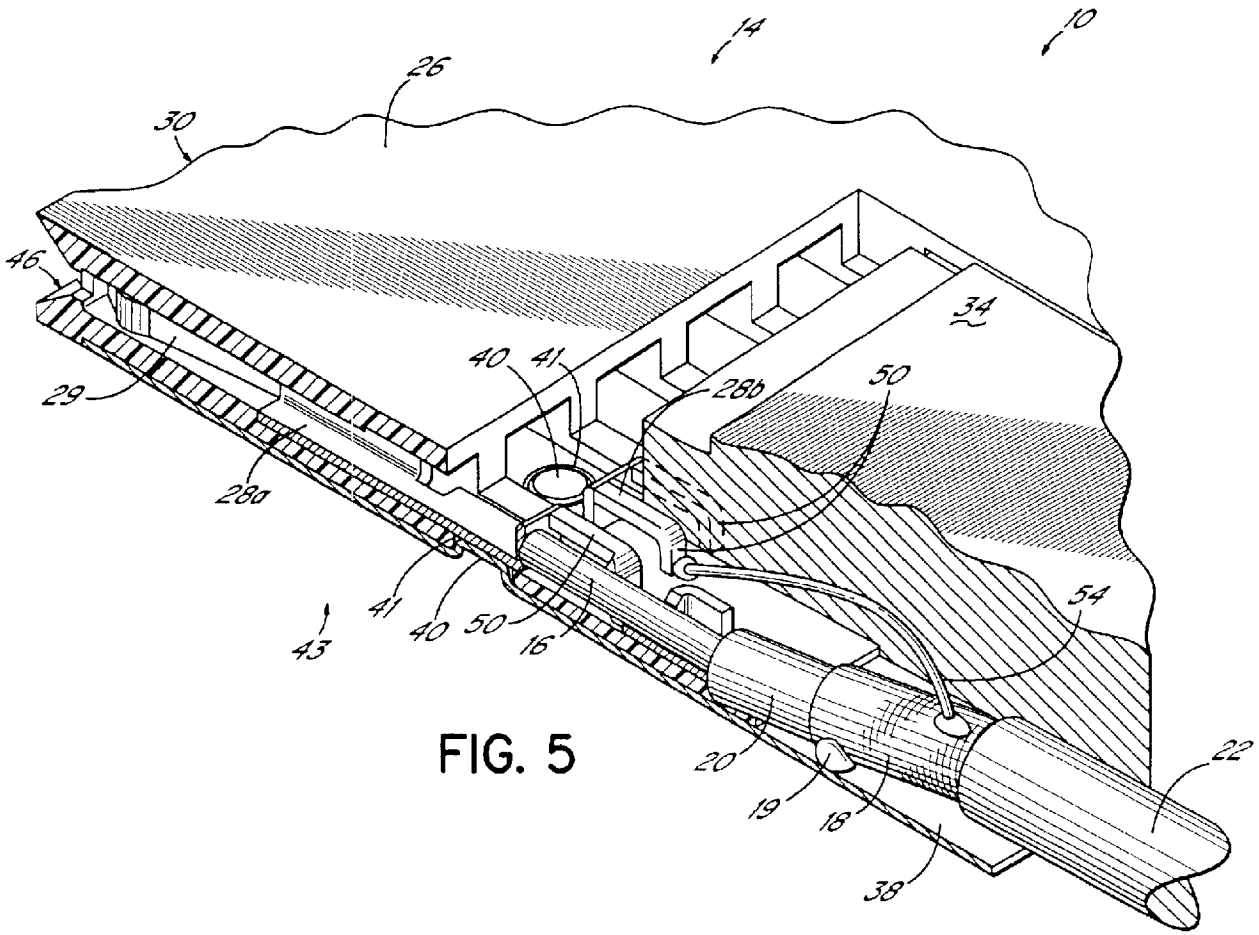
FIG. 5 is a perspective view, partially cut away, illustrating coupling of cables to the contacts of the connector.

Referring to FIG. 2, the connector 14 comprises a connector housing 24 formed of a suitable plastic material, a portion of which may be molded around the other components of the connector. One suitable material for molding a portion of or the entire connector housing 24 is a liquid crystal polymer such as the VECTRA™ polymer available from Celanese. In one suitable manufacturing process for forming the connector housing, a portion or piece of the housing is pre-formed and another portion of the housing is molded around the pre-formed portion and the other components of the connector. For example, a portion or piece 26 of the housing 24 may be pre-formed and configured to contain electrical contacts 28 into which the conductors of the transmission lines terminate (see FIG. 1). The housing will contain a plurality of such contacts which will generally be positioned proximate a front end 30 of the housing, while the conductors 16,18 feed into the housing at the rear end 32. A rear portion 34 of the housing, which surrounds sections of the cables 12 and part of the front portion 26 of the housing, might be molded over the pre-formed portion 26 to form the complete connector housing 24. Housing portion 26 houses the plurality of contacts (see FIGS. 1 and 5) and defines the positions of the contacts in the connector so that the connector may properly engage a socket in an electrical device or backplane. The rear portion 34 of the housing surrounds sections of the cables 12 to ensure that the cables are secured to the connector 14 and that the various conductors of the cables are properly positioned for engaging the respective contacts 28. The molded portion 34 of the housing provides strain relief for the cables 12 and prevents them from being pulled from the connector. Therefore, portion 34 of the connector housing is often referred to as the strain relief portion of the connector. The housing 14 is configured such that openings 46 are formed in the front end 30 so that the contacts 28 may engage the respective contacts of an electronic device when the cable structure is coupled to a device. For example, the cable structure may be plugged into a socket wherein the contacts are pins which fit into the openings 46 and are grasped by the contacts 28. The contacts 28 are configured for engaging contacts of a device when the cable structure is coupled to a device. To that end, the contacts may be any suitable form to achieve that result. In FIG. 5, the contacts are shown with spring fingers 29 which are configured to grasp a contact pin (not shown). Because FIG. 5 is shown cut away, only one finger 29 of an opposing pair is shown. The connector housing 24 may take numerous forms and the housing shape shown in the Figures is only one embodiment of a suitable housing. As will be understood by a person of ordinary skill in the art, the housing shape and contacts will depend upon the ultimate end application of the cable structure and the device to which it must connect.

Referring the FIGS. 1 and 5, the cable structure 10 may further comprise a metal shield 38 which overlies one face 43 of the connector housing 24. The shield 38 is electrically coupled to a ground conductor 18 and is therefore grounded for reducing interference and cross-talk in the cable structure, according to well-known principles. In one embodiment of the invention, the shield is formed of a phosphor bronze metal. Referring to FIG. 5, the shield 38 includes a dimple or detent 40 which extends through an appropriately formed opening 41 in the housing to couple to an appropriate contact 28. The shield dimple 40 may then be welded (e.g. resistance welded) to the appropriate contact 28. The shield will generally extend over a significant portion of the face 43 of the housing for providing sufficient shielding from interference and cross talk. In FIG. 5, dimples 40 are shown for two adjacent contacts for the purpose of illustration. The forwardmost contact 28*a* in the drawing, as discussed below, is coupled to a signal or center conductor 16 and thus will be defined as a signal contact. As noted above, the shield is grounded, and thus would not actually be coupled to a signal contact 28*a*. However, for the purposes of illustration only, the cutaway of the dimple 40 and housing opening 41 are shown with contact 28*a*, as well as a ground contact 28*b*, even though it will only be used to couple shield 38 to the ground contact 28*b*.

Within the cable structure 10, the various contacts 28 will either be a signal contact or a ground contact. That is, the contact 28 will either be connected to the center conductor 16 carrying the data signal or the ground conductor 18 which is grounded. In forming the cable structure 10, particularly when forming the connector 14, various conductors 16, 18 are coupled to the appropriate contacts 28, as shown in FIG. 1. Next, the rear portion 34 of the housing is added, as shown in FIG. 2, such as by molding the housing portion 34 over sections of the cables 12, over part of the housing portion 26, and over parts of the contacts 28 that are not already covered by housing piece or portion 26. The molded housing portion 34 may not completely cover portions 26, and openings 35 may remain, providing exposure of the contacts 28 through the housing for access, if necessary. When coupling the conductors to the appropriate contacts, different embodiments of the connector might be utilized. In one embodiment, the center conductor 16 is coupled to an appropriate contact 28*a* (see FIG. 5). Center conductor 16 may either be welded to the contact 28*a* or might be physically gripped by the contact due to the configuration of the contact. For example, as may be seen in FIGS. 1 and 5, opposing finger sections 50 of the contact might be configured to physically grip the center conductor 16. Alternatively, the center conductor 16 might be welded to the contact 28*a* (not shown). However, a combination of both physical gripping and welding might be utilized to secure the center conductor 16 to the contact. In the embodiment of the invention illustrated in the drawings, coupling the center conductor 16 to a contact 28*a* will define that contact as a signal contact.

Connector 14 also includes ground contacts which are electrically grounded. Conductor 18 is grounded and is coupled to an appropriate contact for defining a ground contact. For example, contact 28*b*, shown in FIG. 5, might be designated a ground contact. In one embodiment of the invention, the conductor 18 may be electrically coupled (such as by welding) to a jumper wire 54, which is then jumped to the contact 28*b* and welded or soldered thereto forming the ground contact 28*b*. To ground shield 38, the dimple 40 is formed in the shield and is resistance welded to contact 28*b* as illustrated in FIG. 5. In such an embodiment, the cable 12 grounds the contact 28*b* which then, in turn, grounds the shield 38. Alternatively, the conductor 18 might be soldered directly to the shield 38, as shown by solder bead 19 in FIG. 5. The dimple 40 is then resistance welded to the contact 28*b*. In such an embodiment, the shield 38 is directly grounded by the ground conductor 18 and the contact 28*b* is then indirectly grounded by its contact with shield 38. In either case, both the shield and contact 28*b* are grounded. It will also be readily understood to a person of ordinary skill in the art, that the shield might be coupled to the contacts and/or to the ground conductor in other suitable ways.

Referring to FIG. 1, the shield includes tangs 55 which couple to the housing portion 34. The tangs include apertures 56 through which molten plastic may flow when housing portion 34 is molded around the cables 12 and part of housing portion 26. In that way, the shield 38 is secured to connector 14.

As noted above, the formation of connector 14 on the end of the cable structure, and particularly, the molding of housing portion 34, exposes the ends of the individual cables 12 to significant heat and pressure associated with the molding process. This degrades the overall integrity of the cable structure by deforming the individual cables 12 and making the entire structure less robust and more subject to failure. In accordance with one aspect of the present invention, a protective clamp covers sections of the cables which are coupled to the connector housing. As shown in FIG. 1, the protective clamp is positioned or interposed between part of the connector housing portion 34 and sections of the cables which are surrounded by the connector housing portion to provide protection to the cables when the housing portion 34 is formed thereon. Referring to FIG. 2, the contacts 28 are positioned in housing portion 26 and the housing portion 26 houses and surrounds the contacts. In the embodiment illustrated in the figures, the protective clamp 60 is shown positioned rearwardly of the contacts and housing portion 26 and rearwardly of the termination end of the individual cables 12. The protective clamp 60 is formed of a material sufficiently rigid to offer mechanical protection to sections of the cables which interface with the connector housing portion 34, specifically where the connector housing portion is molded around certain sections of the termination ends of the cables. One suitable protective clamp is a metal clamp formed out of a beryllium-copper alloy having a thickness of approximately 3–5 mils. Referring to FIG. 1, one embodiment of the protective clamp 60 is formed as a clamshell clamp having an upper part or portion 60*a* and a lower part or portion 60*b* which is similarly formed. The clamp parts 60*a*, 60*b* come together in generally a clamshell arrangement as illustrated in FIG. 1 to protect certain sections of cable 12. The clamp covers sections of cables 12 at the position where the cables exit from the connector housing 24, and particularly from housing portion 34. The clamp parts 60*a*, 60*b* are appropriately configured to cover and protect sections of the cables. Each clamp part includes side tabs 62 and arcuate portions 63 extending between the tabs 62. In the embodiments shown, the cables have generally circular cross-sections and the arcuate portions 63 are appropriately formed to match the radius of the circular cable cross-sections for a tight fit around the cables. The side tabs 62 are similarly formed in the opposing clamp parts. In each of those tabs 62, an aperture 64 is formed, and the apertures are aligned when the clamp parts 60*a*, 60*b* are together. When the housing portion 34 is molded onto the cable ends and around the protective clamp 60, molten plastic flows through the apertures 64 to thereby couple the clamp to housing portion 34, lock the clamp into position, and secure the clamp parts together around the protected portion of the cable. The clamp might be formed of two separate parts or may be formed as a single structure with halves that are hingedly attached.

Figure 3:
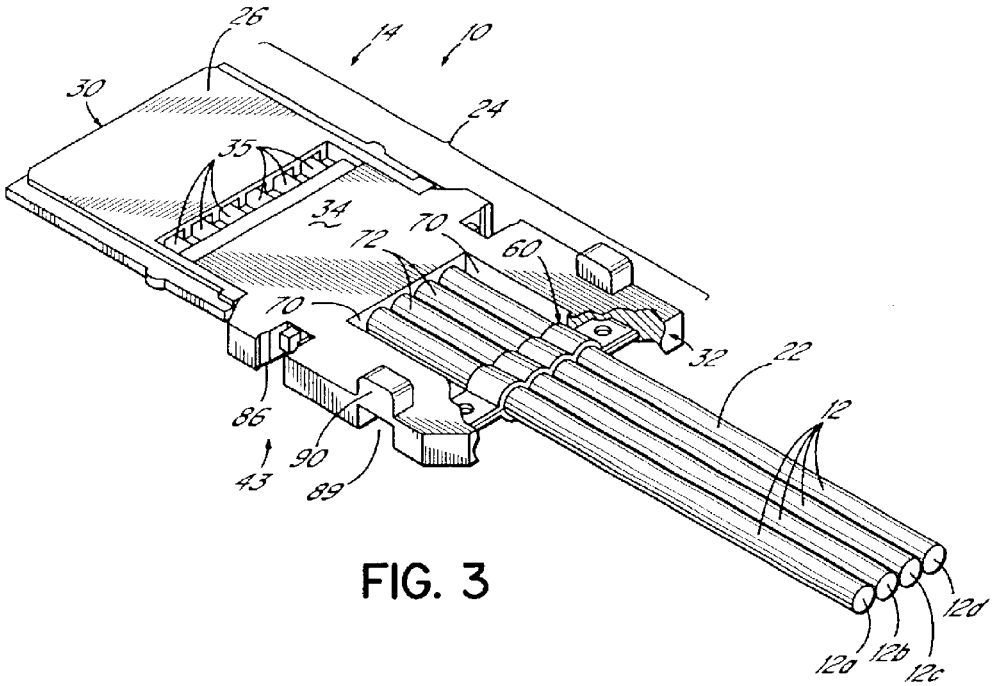
FIG. 3 is a view similar to FIG. 2 showing a portion of the connector housing cut away to illustrate the protective clamp in one embodiment of the invention.

Clamp 60 may be suitably dimensioned and appropriately formed to cover each of the sections of the cables of the cable structure 10. As illustrated in the drawings, a four cable clamp is utilized. The clamp may be dimensioned in length to protect certain sections of the cable during formation of the connector 14. As illustrated in FIGS. 2 and 3, an open window 70 is formed in housing portion 34 between the clamp 60 and the individual housing portion 26. The open window 70 in portion 34, exposes cable sections 72 and thereby further minimizes damage to the ends of the cable during formation of the connector housing 24. The exposed sections 72 of the cables are not generally subjected to the heat and pressure associated with the molding of portion 34 around the cables. Therefore, protective clamp 60, is shown with a length L sufficient to protect the sections of the cables 12 which are coupled to the housing portion 34 when it is molded therearound. Referring to FIG. 3, sections of the clamp 60 may be seen beneath housing portion 34 to protect the cable sections covered by housing portion 34.

Figure 4:
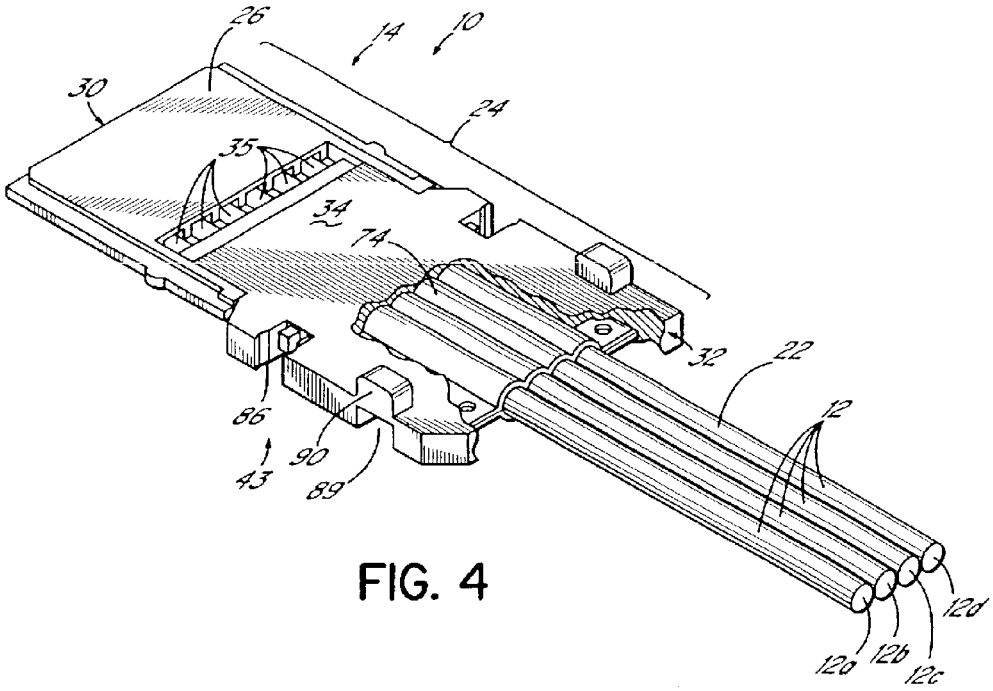
FIG. 4 is a perspective view, partially cut away, illustrating an alternative embodiment of the invention.

Alternatively, the connector housing 24 might be formed without an open window, thus exposing significantly larger sections of the cable ends to the heat and pressure of the molding process. In such an embodiment, a clamp 74 might be configured and dimensioned as illustrated in FIG. 4 for further protecting cable sections covered by housing portion 34. The inventors have found that the protective clamp in combination with the cable structure of the invention improves the overall integrity and performance of the cable structure 10.

In accordance with another aspect of the present invention, as illustrated in FIGS. 2 and 3, the open window 70 might be utilized in combination with the protective clamp 60 in order to further improve the integrity and robustness of the cable structure 10 and the connector 14. The inventors have further found that the combination of the protective clamp 60 and the window 70 also enhances the integrity of the cable structure and its performance.

Figure 6:
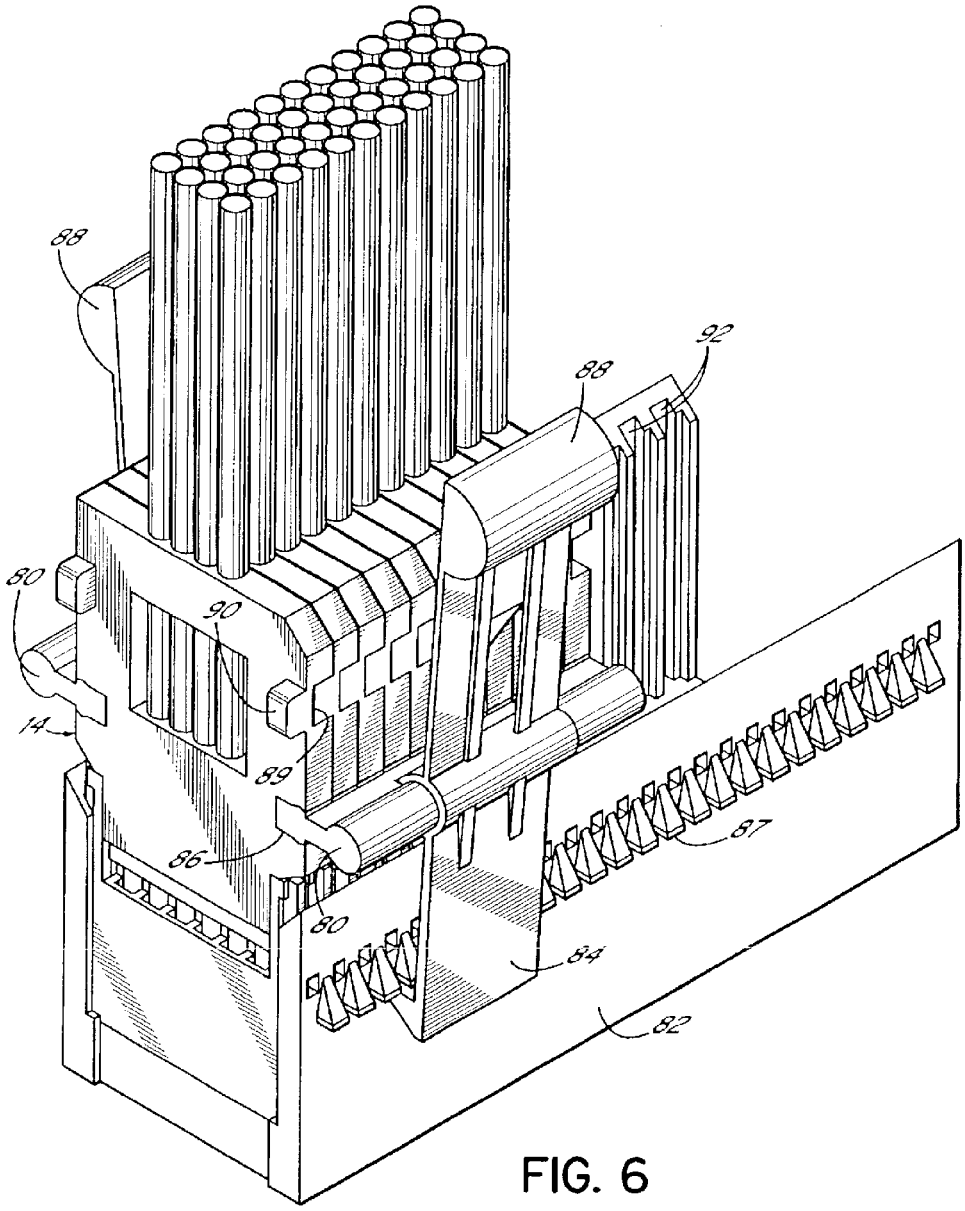
FIG. 6 is a perspective view illustrating one embodiment of the invention, coupled together in a high density formation within a socket.

In accordance with another aspect of the present invention, as illustrated in FIG. 6, connector 14 comprises a latch tab or comb 80 located on either side of the connector 14. As illustrated in FIG. 6, cable structure 10 and connector 14 are formed to be generally thin. For example, one suitable thickness T for the connector 14 is 2 millimeters. In use, the thin connectors 14 may be stacked on top of each other or side by side as illustrated in FIG. 6. In that way, they can be connected in very high densities to a device, such as the socket 82. Socket 82 may be coupled to other electronic devices and network components, as appropriate, such as to a backplane for a network. Socket 82 includes a plurality of pins (not shown) which extend into the openings 46 formed in the front end 30 of the connector housing 24 to facilitate electrical connection between the socket device 82 and the cable structures 10. The connectors illustrated in the figures are suitable for such high density connections.

Once plugged into or otherwise connected to the device 82 in the high density format as illustrated in FIG. 6, a latch structure 84 engages one or more latch tabs or combs 80 of the connectors to lock the connectors 14 into the socket 82. The tabs or combs 80 give the connector structure greater rigidity. In one embodiment of the invention, each connector 14 may include opposing latch tabs, and the latch tabs 80 may be separate pieces which engage appropriately formed notches 86 in the connector housing. In such a case, each connector would be engaged by a latch structure 84 to hold the connector in the socket. Alternatively, as illustrated in FIG. 6, the latch tabs 80 might be formed as elongated structures or combs so that a single latch tab is coupled to multiple stacked connectors 14. In that way, the latch structure 84 only has to engage a portion of the tab 80, as illustrated, to lock all of the connectors into the socket. Furthermore, with longer single latch tabs 80, the various connectors are further coupled together into a more rigid structure. The latch structure 84 cooperates with teeth 87 to secure the connectors 14 in the socket 82. Handles 88 facilitate manipulation of the latch structure 84 to engage the latch tabs 80. The latch structure 84 is appropriately configured to engage a section of latch tab 80 and thereby latch or lock the connectors into socket 82. As illustrated in FIGS. 2 and 6, the connector housing, and particularly portion 34 of the housing, may be formed with appropriate notches 89 and alignment pins 90 so that the alignment pins of the connector engage the notches of an adjacent connector when the connectors are stacked in a high density fashion such as within a socket as illustrated in FIG. 6. In that way, all the connectors are properly aligned so that the contacts with those connectors are able to interface properly with the contacts of the socket 82. In further reference to FIG. 6 and the embodiment illustrated therein, the connector housing 24 is appropriately formed for engaging slots 92 formed in the socket 82.

The drawing of FIG. 6 illustrates latch tabs or combs 80 which have generally cylindrical outer ends that are engaged by the latch structures 84. It should be understood that the tabs may take other shapes and that the latch structures may also be modified to take a different appropriate shape for engaging the latch tabs.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A method of making a cable structure for data signal transmission, the method comprising:

coupling an electrical conductor of an end of a cable to an electrical contact positioned within a portion of a connector housing;

positioning a protective clamp over a section of the cable rearwardly of the electrical contact;

molding a portion of said housing around said section of the cable and protective clamp, to thereby secure the cable with the connector housing;

the protective clamp positioned between the molded portion of the connector housing and the cable section and configured for providing mechanical protection for the cable section during the molding step to reduce damage thereto;

whereby the integrity of the cable structure is enhanced.

2. The method of claim 1 wherein said protective clamp is made of metal.

3. The method of claim 1 further comprising positioning a metal shield on a face of the housing.

4. The method of claim 1 wherein the protective clamp includes at least two pieces, the method further comprising positioning the pieces around the cable section prior to molding the housing portion.

5. The method of claim 1 wherein said protective clamp comprises an aperture therein, the molded portion of the housing engaging said aperture to couple the housing portion and clamp together on the section of the cable.

6. The method of claim 1 further comprising forming the housing portion to include an open window section positioned between the contacts and the protective clamp, the open window section exposing a portion of the cable.

7. The method of claim 1 wherein the cable includes a signal conductor and a ground conductor, the method comprising electrically connecting the signal conductor to a contact and electrically connecting the ground conductor to a different contact, and positioning a metal shield on a face of the housing and electrically coupling the shield to the grounded contact.

8. The method of claim 7 wherein said metal shield includes a dimpled portion, the method comprising engaging the grounded contact with the dimpled portion to provide the electrical coupling thereto.

9. The method of claim 1 wherein the cable includes a signal conductor and a ground conductor, the method comprising electrically connecting the signal conductor to a contact and positioning a metal shield on a face of the housing and electrically connecting the shield to said ground conductor, and further electrically coupling the metal shield to a different contact.

* * * * *